US005160273A

United States Patent [19]

Carney

[11] Patent Number: 5,160,273

[45] Date of Patent: Nov. 3, 1992

[54] CONNECTOR BLOCK ASSEMBLY

[75] Inventor: William V. Carney, Oyster Bay, N.Y.

[73] Assignee: Porta Systems Corp., Syosset, N.Y.

[21] Appl. No.: 719,939

[22] Filed: Jun. 24, 1991

[51] Int. Cl.[5] ..... H01R 13/648

[52] U.S. Cl. ..... 439/108; 439/608

[58] Field of Search ..... 439/101, 108, 608, 79, 439/924, 545, 549

[56] References Cited

U.S. PATENT DOCUMENTS

| | | | |
|---|---|---|---|
| 3,138,675 | 6/1964 | Krone | 200/51 |
| 3,399,372 | 8/1968 | Uberbacher | 439/101 |
| 3,766,513 | 10/1973 | Carre | 339/31 |
| 3,871,728 | 3/1975 | Goodman | 339/14 |
| 4,017,768 | 4/1977 | Valfre | 361/399 |
| 4,053,719 | 10/1977 | Debortoli et al. | 179/98 |
| 4,149,211 | 4/1979 | De Hoff | 361/119 |
| 4,227,763 | 10/1980 | Marks | 339/99 |
| 4,262,173 | 4/1981 | Saligny | 179/98 |
| 4,279,460 | 7/1981 | Forberg | 339/97 |
| 4,281,885 | 8/1981 | Forberg et al. | 339/14 |
| 4,283,103 | 8/1981 | Forberg et al. | 439/404 |
| 4,345,294 | 8/1982 | Forberg et al. | 361/119 |
| 4,410,225 | 10/1983 | Stoewe et al. | 339/31 |
| 4,510,553 | 4/1985 | Faultersack | 361/413 |
| 4,512,622 | 4/1985 | Carney et al. | 339/103 |
| 4,527,852 | 7/1985 | Dechelette | 339/97 |
| 4,533,196 | 8/1985 | Forberg et al. | 439/404 |
| 4,547,034 | 10/1985 | Forberg et al. | 339/97 |
| 4,616,288 | 10/1986 | Scholtholt et al. | 361/119 |
| 4,621,885 | 11/1986 | Szczesny et al. | 439/357 |
| 4,634,209 | 1/1987 | Forberg et al. | 339/147 |
| 4,659,155 | 4/1987 | Walkup et al. | 339/14 |
| 4,688,865 | 8/1987 | Kelly | 439/108 |
| 4,729,064 | 3/1988 | Singer, Jr. | 361/426 |
| 4,734,041 | 3/1988 | Bruchmann et al. | 439/637 |
| 4,741,711 | 5/1988 | Singer, Jr. | 439/620 |
| 4,758,921 | 7/1988 | Hung | 361/119 |
| 4,822,306 | 4/1989 | Klaiber | 439/709 |
| 4,840,568 | 6/1989 | Burroughs et al. | 439/49 |
| 4,846,735 | 7/1989 | Teichler et al. | 439/709 |
| 4,862,304 | 8/1989 | Yunoki et al. | 360/121 |
| 4,875,868 | 10/1989 | Cwirzen et al. | 439/188 |
| 4,901,190 | 2/1990 | Scholtholt | 361/119 |
| 4,971,581 | 11/1990 | Lace | 439/625 |
| 4,986,768 | 1/1991 | Bramkamp et al. | 439/680 |
| 5,024,609 | 6/1991 | Piorunneck | 439/637 |
| 5,026,292 | 6/1991 | Pickles et al. | 439/108 |
| 5,046,960 | 9/1991 | Fedder | 439/608 |

OTHER PUBLICATIONS

Research Disclosure, "Duel-Level Printed Circuit Board Edge Connector", Aug. 1987, No. 280.

LSA-Plus, Krone Catalog, 6 pages, Issue 9.90.

The 16 MBPS Data Block, Krone, Englewood, Co., 2 pages.

Telephony, 100 Pair Protected I.D.C. Connect/Disconnect-Terminal Block, Mars Alcatel, 2 pages.

"la Connection", Henry Pouyet 1985 Catalog Standard Products, 6 pages.

*Primary Examiner*—Gary F. Paumen

*Attorney, Agent, or Firm*—Fitzpatrick, Cella, Harper & Scinto

[57] ABSTRACT

A connector block assembly for connecting closely spaced wired on which high frequency signals are present, contains pairs of spring finger connectors with electrically conductive shields between different pairs. Ground contacts are arranged to be engaged by an insert module in advance of its engagement with the spring fingers and a detents and projection arrangement serves to hold the insert module at different operating positions.

19 Claims, 9 Drawing Sheets

CONNECTOR BLOCK ASSEMBLY

BACKGROUND OF THE INVENTION

1. Field of the Invention

This invention relates to wire connecting arrangements and more particularly it concerns novel connector block assemblies for connecting closely spaced wires on which high density voice or data information is being conducted.

2. Description of the Related Art

There is a need in the telecommunications industry to transmit large volumes of voice or data information along groups of lines that are closely spaced from each other. Moreover, in order to maintain flexibility as equipment is added or replaced in a telecommunications system, it is important to have connection stations at one or a few locations where connections to a large number of pieces of equipment can be made. This raises certain problems because in order to carry large volumes of information over electrical lines, the information must be transmitted at high frequency and this gives rise to radiation and interference between adjacent lines, particularly where the lines are closely spaced from each other. The radiation and resulting "cross-talk" can be minimized by transmitting the information over twisted wires or over wires that are encased in a conductive sheath. However, when the wires are brought to a connection station, the connectors cannot practically be twisted or encased in a conductive sheath; and because they are close to each other their is a tendency for cross-talk.

The problem of cross-talk is not particularly severe at low frequencies, for example, less than about 16 megahertz (Mhz); however there is a demand for transmission at much higher frequencies, in the neighborhood of 100 Mhz and at those frequencies, radiation is higher and there is a need for greater attenuation between adjacent conductors.

There is also a need for a connector block assembly that is compact and that can handle a very large number of connections in a small space. At the same time the connector assembly must provide easy access and must be fail safe.

U.S. Pat. Nos. 4,741,711, 4,533,196 and 4,283,103 show prior art connector assemblies of the type to which the present invention is applicable. Each of these patents shows connector block assemblies in which a plurality of spring finger contact elements are located. However, none of them address the problem of cross talk between adjacent connector elements or groups of connector elements. Also, none of the prior art arrangements shows a spring finger grounding arrangement which is engaged by an insert module prior to engagement with signal conducting contacts. In addition, the prior art does not disclose a reliable yet simple means for holding an insert module at different operating positions in a connector assembly.

SUMMARY OF THE INVENTION

The present invention provides improvements to connector block assemblies which enable the handling of a large number of connections of wires in a small space in a convenient manner and with a minimum of cross-talk even at high frequency transmission.

According to one aspect of the present invention there is provided a novel connector assembly for providing a plurality of closely spaced connections to wires which conduct high frequency electrical signals. This connector assembly comprises an elongated insulative block, a plurality of connector elements mounted in closely spaced arrangement within the block and a plurality of electrically conductive shields. The block is formed with openings which provide access for individual wires to be connected to the ends of corresponding ones of the connector elements; and the electrically conductive shields are mounted within the block between adjacent connector elements to prevent crosstalk between the connector elements.

According to another aspect of the invention there is provided a novel connector block assembly which comprises an insulative block, a pair of electrically conductive signal contacts and a ground contact mounted in the block. The signal contacts each have a spring finger biased to contact the spring finger of the other contact. The block is formed with an opening providing access to a probe which can be inserted into the block to engage and separate the spring fingers. The ground contact is mounted between the opening and the spring fingers to be contacted by the probe when it is inserted into the block and before it engages the spring fingers.

According to a further aspect of the invention there is provided a novel connector block assembly which comprises an insulative block, a pair of electrically conductive signal contacts mounted in said block and an insert module. The signal contacts each having a spring finger biased to contact the spring finger of the other contact. The block is also formed with an opening providing access to the spring fingers. The insert module has a projecting insert element which fits through the opening in the block and engages and separates the spring fingers; and it also has a module casing which holds the projecting insert element. The block and the casing are configured such that each has a surface which slides along a corresponding surface of the other as the module is inserted into and withdrawn from the block. One surface is formed with a detent and the other is formed with a projection which fits into the detent to hold the insert module in fixed position relative to the spring fingers.

DETAILED DESCRIPTION OF THE PREFERRED EMBODIMENT

Figure 1:
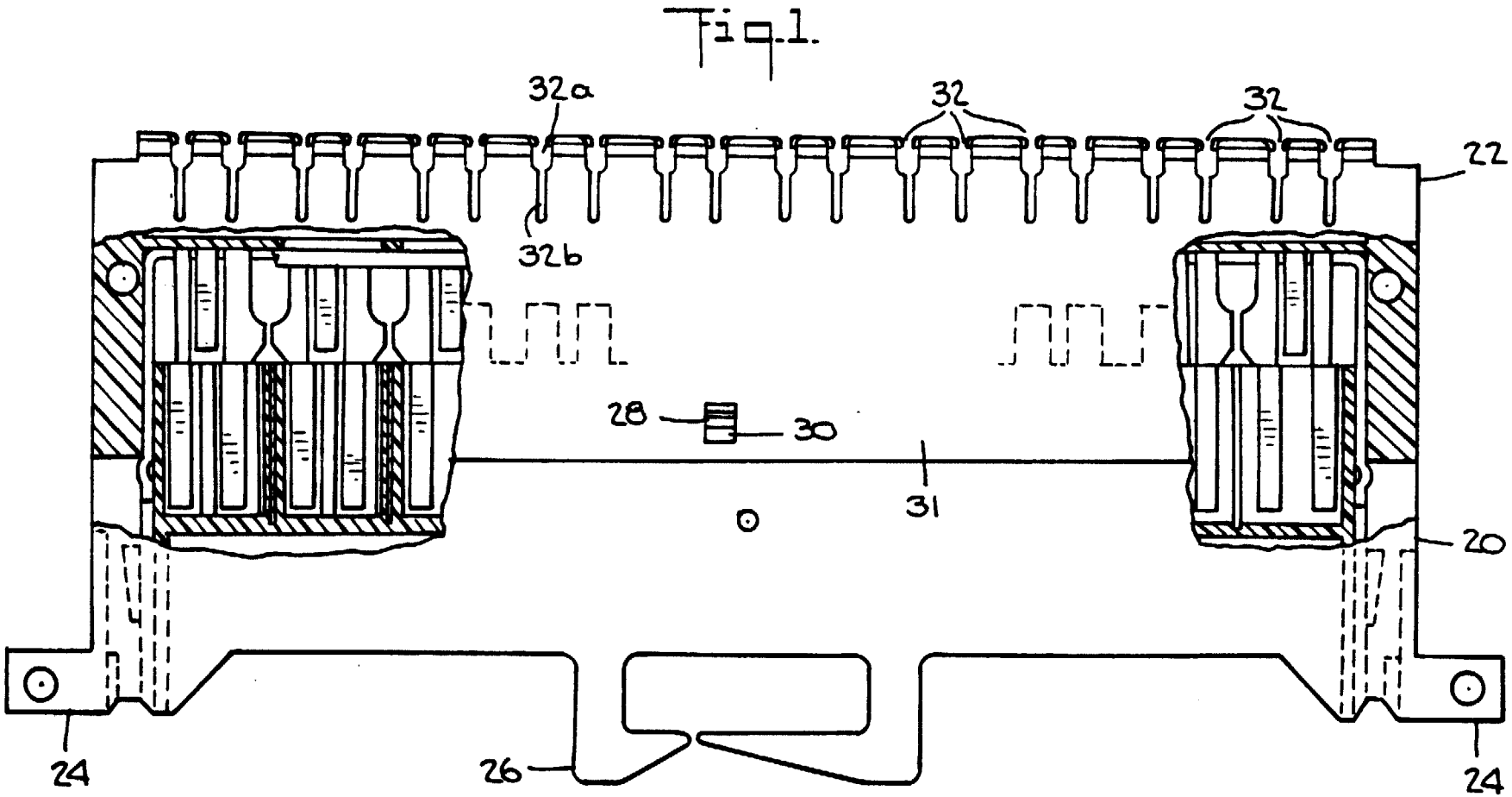
FIG. 1 is a top view of a multiple wire connector block assembly which comprises one embodiment of the present invention.
Figure 2:
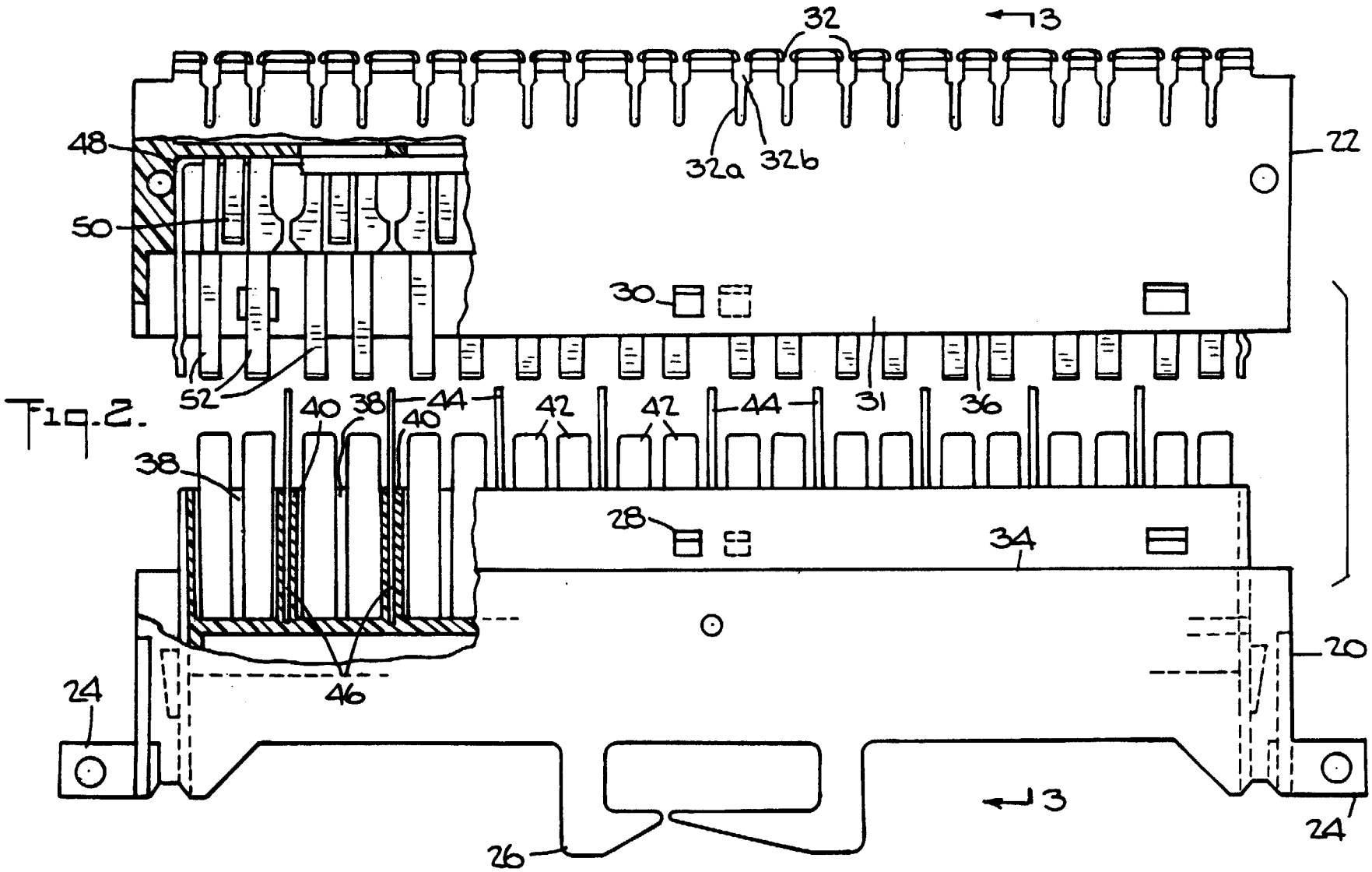
FIG. 2 is an exploded top view of the connector block assembly of FIG. 1, showing a base and a contact holder separated from each other with the base and contact holder portions partially cut away.
Figure 3:
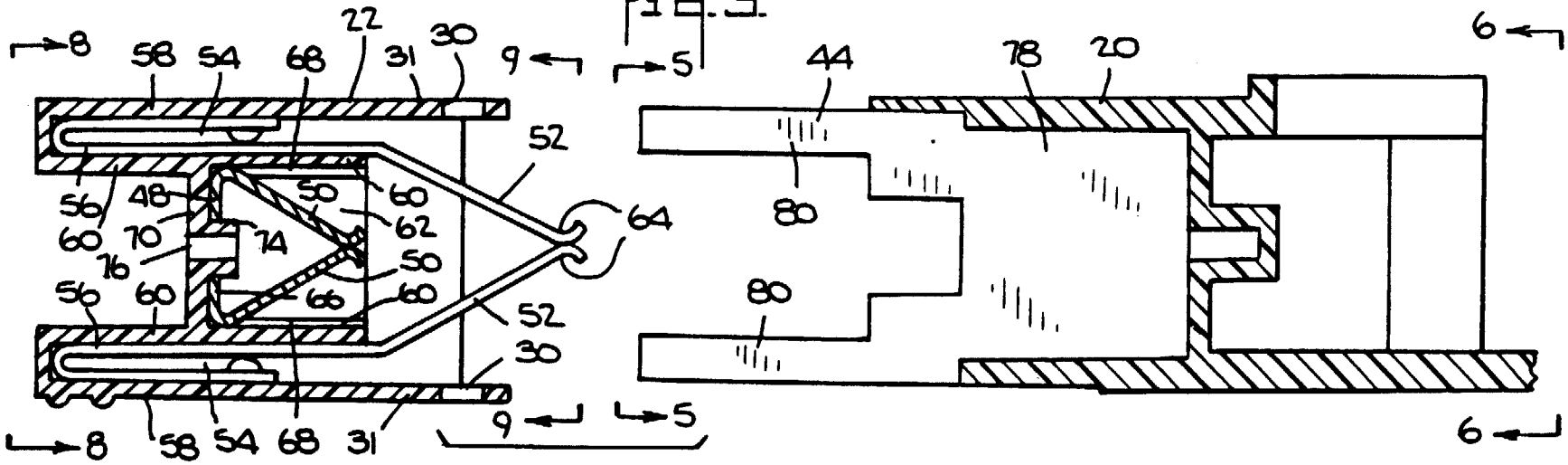
FIG. 3 is an enlarged sectional view taken along lines 3—3 of FIG. 2.

The connector assembly of FIGS. 1-3 is used to connect pairs of wires (not shown) from individual telephone trunks to a central station. However, identical or similar connector assemblies may be used for interconnection of other equipment, for example, voice or data lines in a computer network.

As shown in FIGS. 1-3, the connector assembly comprises an elongated base 20 and an elongated contact holder 22, each molded of plastic material in a generally block-like form. The base 20 is formed with mounting tabs 24 at each end, and a cable harness 26 along one side. As can be seen in the cutaway portions of FIG. 1, and as will be described more fully hereinafter, the base 20 is formed with internal cavities in which connector, ground and shield elements are mounted. The contact holder 22 fits onto the base 20 and is snap locked onto the base by means of projections 28 along the upper surface of the base. These projections extend into recesses or openings 30 in a skirt portion 31 of the contact holder which fits over a mating part of the base 20.

As can also be seen in the cutaway portions of FIG. 1, and as will be described in detail hereinafter, the contact holder 20 is also formed with internal cavities into which the connector, ground and shield elements extend. One side of the contact holder 22 is formed with slots 32 into which wires to be connected are inserted. The slots 32 each have first wider portion 32*a* for guiding a wire into a second narrower portion 32*b*. The width of the narrower portion 32*b* is chosen to be less than the overall diameter of an insulated wire to be connected, but greater than the diameter of the conductor portion of the wire. This allows the wires to be held tightly in the slots without imposing any strain on their conductor portions.

As shown in FIG. 2, the base 20 has a shoulder 34 along one side and against which an edge 36 of the skirt portion 31 of the contact holder abuts in assembly. The projections 28 are formed near the shoulder 34 at spaced apart locations along the length of the base 20. Similar projections and recesses are provided along the bottom surfaces of the base 20 and the contact holder 22.

The base 20 is also formed with recesses 38 separated by walls 40 for accommodating pairs of connectors and ground elements. Also, pairs of fingers 42 extend out from the base 20 on each side of each of the recesses 38 for holding connectors in place in the contact holder 22. Electrically conductive shield plates 44 extend between the recesses 38 and are held in slots 46 provided in the walls 40.

The contact holder 22 has mounted therein, in slot and cavity arrangements described more fully hereinafter, an electrically conductive ground strip 48 from which spring finger ground elements 50 extend, as well as pairs of electrically conductive, spring finger connector elements 52.

The exploded section view of FIG. 3 is taken through a plane in the body 20 which passes through the slot 46 in one of the walls 40. As can be seen, when the contact holder 22 is assembled onto the body 20, the spring finger connector elements 52 and the spring finger ground elements 50 pass behind the shield 44 in the body 20. The contact holder 22, as shown in FIG. 3, is formed with outer recesses 54 distributed along the length of the holder near the top and bottom thereof and into which wire attachment ends 56 of the connector elements 52 extend. As can be seen in FIG. 3, these outer recesses 54 are formed between outer walls 58 and associated inner walls 60. The outer walls 58 continue beyond the recesses 54 to form the skirt portions 31. Separate recesses 54 are provided for each of the connector elements 52, which are distributed in groups of opposing pairs with the spring finger ends of the elements of each pair extending from opposite sides of the contact holder 22 to contact each other along the center line of the holder. The inner walls 60 extend continuously along the length of the contact holder 22 and form between them an elongated ground strip channel 62. The ground strip 48 is mounted in the ground strip channel 62.

The wire attachment end 56 of each of the connector elements 52 is bent into a U-shaped configuration and fits snugly into an associated connector element recess 54. The other end of each connector element 52 is a spring finger end. The spring finger end extends beyond its associated inner wall 58 and is bent inwardly to form a contact 64 which normally abuts a corresponding contact 64 on the spring finger end of a mating connector element 52. The connector elements 52 are resilient and the mating contacts 64 of each pair of elements are resiliently biased into contact with each other. Preferably the connector elements are stamped out of sheet metal which is resilient and which has high electrical conductivity, for example, tempered pre-plated brass.

The ground strip 48, which extends along the ground strip channel 62, is formed with a generally U-shaped cross-section, comprising an elongated base 66 as well as the spring finger ground elements 50 and shield contact elements 68 which are interspersed with each other and which extend up from along the opposite edges of the base. The ground elements 50 are arranged in pairs and are bent in toward the center of the ground strip channel 62 so that the ground elements of each pair normally contact each other as shown in FIG. 3. However, because these elements are resilient they can be flexed away from each other by insertion of an insert member between them. The shield contact elements 68 extend flat against the inner surfaces of the inner walls 60.

The base 66 of the ground strip 48 rests against a side wall 70 of the contact holder 22. The side wall 70 extends between the upper and lower inner walls 60 along the length of the contact holder.

The side wall 70 is formed with an elongated ridge 74 along the longitudinal centerline thereof and on the side facing the base 20. Insert slots 76 extend through the ridge 74 of the side wall 70 and are distributed therealong to allow the insertion of insert members, for example protector modules, which when inserted, extend between and separate the mating ground elements 50 of the ground strip 48 and the mating contacts 64 of the connector elements 52. As will be explained more fully hereinafter, the base 66 of the ground strip 48 is formed with openings to fit around the slots 76.

Figure 4:
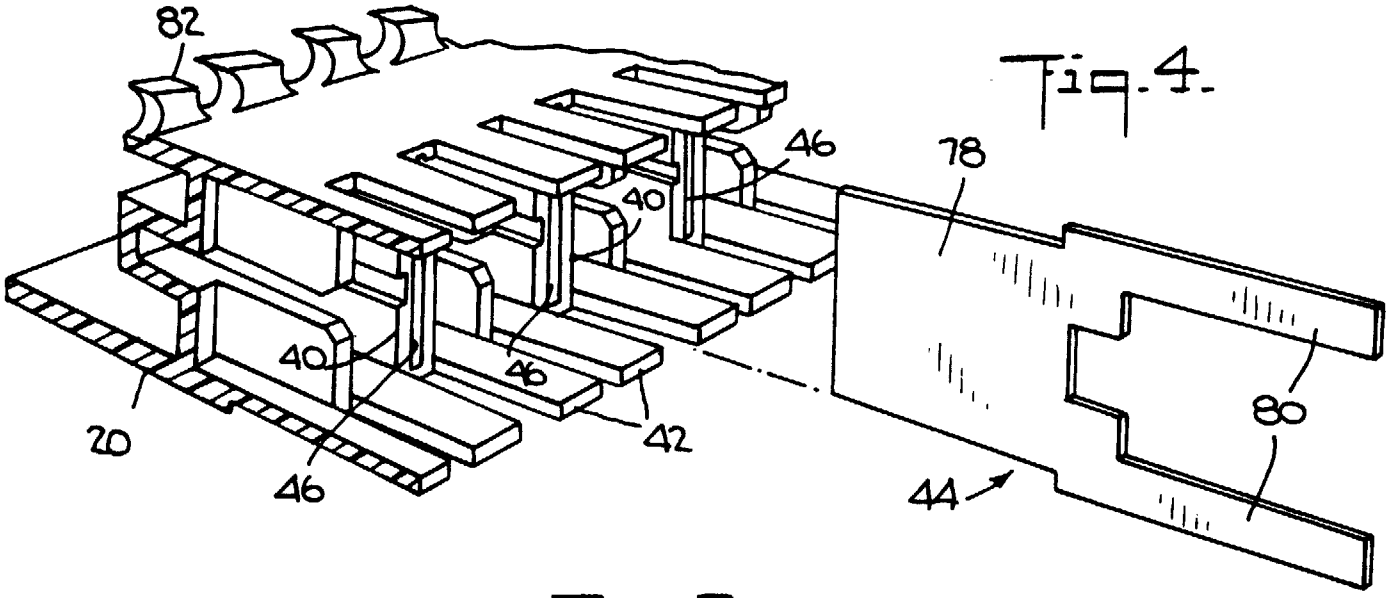
FIG. 4 is a fragmentary perspective view showing the mounting arrangement for an isolation shield in the connector block assembly of FIGS. 1-3.

As can be seen in FIG. 3, each shield plate 44, which is a thin sheet of electrically conductive material, for example copper, is shaped to extend over both the wire attachment ends 56 and the spring finger ends, including the mating contacts 64 of the spring finger connector elements 52. As shown in FIGS. 3 and 4, these shield plates 44 have an expansive main portion 78 which is inserted into one of the slots 46 in the walls 40 of the base 20, and two projecting arms 80 which extend into the contact holder 22 in the assembly. The main portion 78 covers the mating contacts 64 of the connector elements 52 and the projecting arms cover the wire attachment ends 56.

It should be noted that in the exploded views of FIGS. 2 and 3, the shield plates 44 are shown mounted in the base 20. This is merely to provide clarity in showing the structure of the device. Actually, it is preferable to assemble the device by first positioning the shield plates so that their projecting arms 80 fit appropriate slots formed in the contact holder 22. Then, when the contact holder is fitted onto the base 20 the main portions 78 of the shield plates 44 enter into the slots 46 in the walls 40 of the base.

Figure 5:
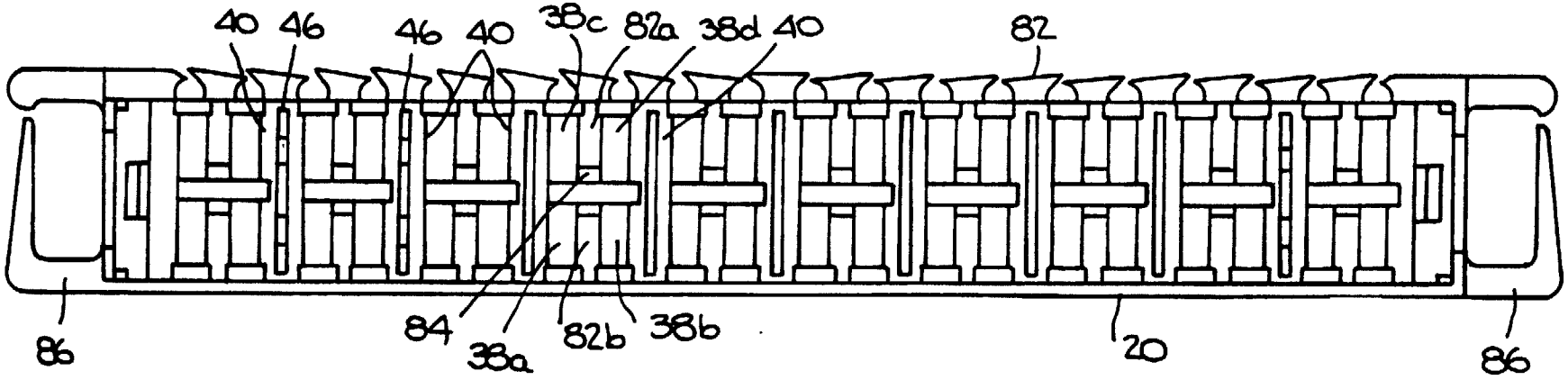
FIG. 5 is a view taken along line 5—5 of FIG. 3.
Figure 6:
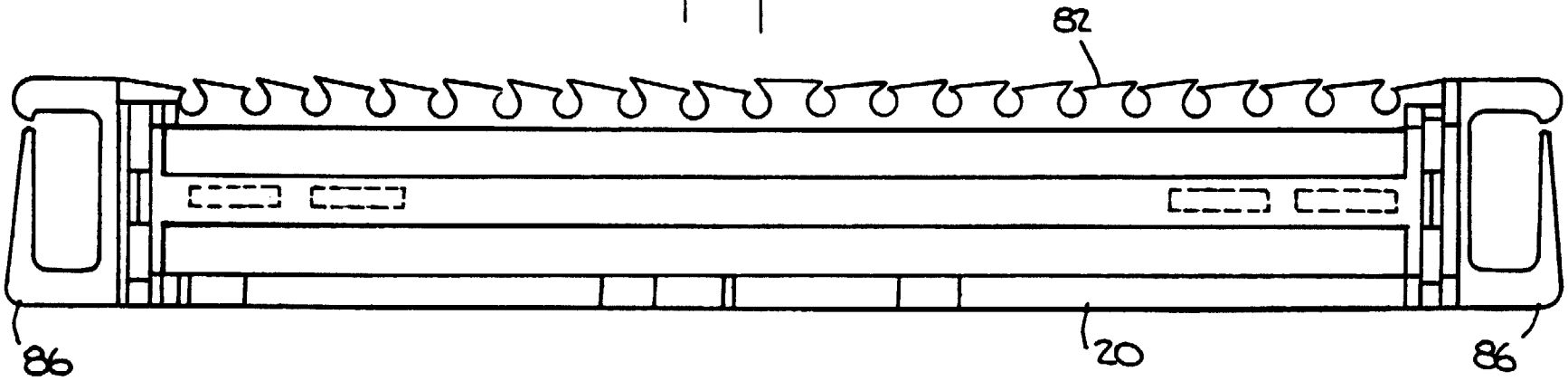
FIG. 6 is a view taken along line 6—6 of FIG. 3.

As shown in FIGS. 4, 5 and 6, wire holders 82 are formed along the top of the base 20. Wires (not shown) to be connected in the device pass up through the cable harness 26 (FIG. 1) and fan out to the various wire holders 81 before entering through the slots 32 in the contact holder 22.

Also, as shown in FIG. 5, each of the recesses 38 in the base 20 is divided into four recesses **38*a*, 38*b*, 38*c* and 38*d* by means of a pair of walls 82*a* and 82*b* which extend parallel to and midway between each of the walls 40. The recesses 38*a* and 38*b* form a first pair and accommodate spring connector elements 52 for a pair of input wires (e.g. tip and ring wires from an outside plant in a telephone system) and the recesses 38*c* and 38*d* form a second pair and accommodate spring connector elements for a pair of output wires (e.g. tip and ring wires for a telephone subscriber line). The walls 82*a* and 82*b* leave a space 84 between them to allow insertion of a probe element which is inserted into the device via the insert slots 76 (FIG. 3**).

FIGS. 5 and 6 also show additional cable harnesses 86 at opposite ends of the base 26.

Figure 7:
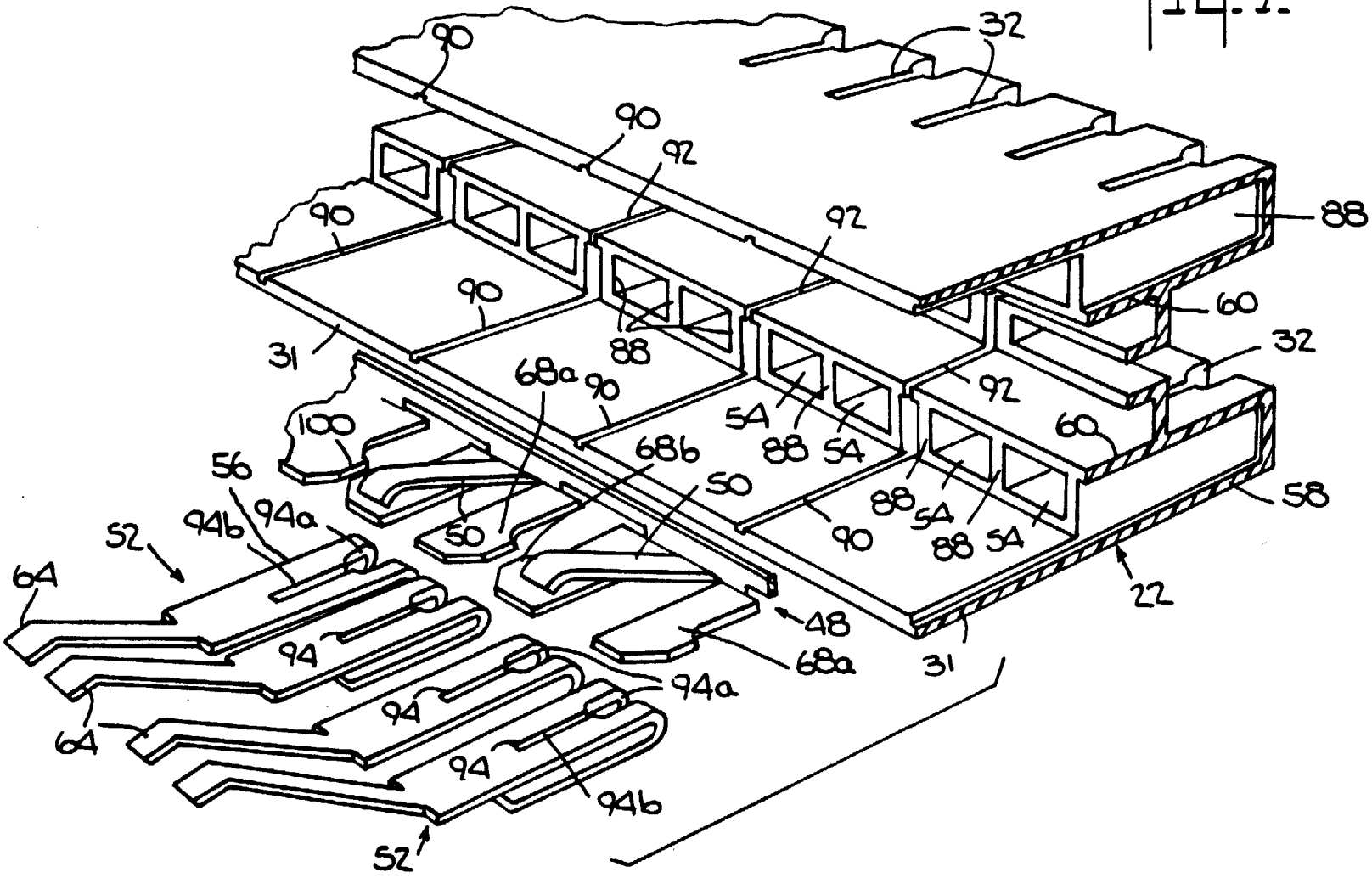
FIG. 7 is a fragmentary perspective view showing the mounting arrangements for connector elements and ground elements in the connector block assembly of FIGS. 1-3.

Turning now to FIG. 7, it will be seen that the recesses 54 in the contact holder 22 are formed by walls 88 which extend between each outer side wall 58 and its associated inner wall 60. Also, grooves 90 are formed in the inside surfaces of the outer walls 58 and the associated skirt portion 31 of the contact holder to accommodate and guide the shield plates 44 along their opposite side edges. Slots 92 extend into alternate ones of the walls 88 as continuations of the grooves 90.

The slots 32 in the contact holder 22 are arranged to be each centrally located with respect to an associated one of the recesses 54. In addition, the U-shaped wire attachment ends 56 of the connector elements 52 are each formed with a corresponding wire connection slot 94, with a wider entry portion **94*a* and a narrower second portion 94*b*. When the wire attachment ends 56 of the connector elements 52 are inserted into the recesses 54 of the contact holder 22, the wire connection slots 94 of the connector elements 52 become aligned with the wire insertion slots 32 in the contact holder 22. The wire connection slots 94 of the connector elements are narrower than the wire insertion slots 32 in the contact holder 22. Thus, as a wire is pressed down into one of the slots 94, the sides of the slot first cut through the wire insulation and then the sides of the narrow second portion 94*b* of the slot bite into and form a positive electrical contact with the conductor portion of the wire. At the same time the narrow portion of the wire insertion slot 32** securely holds the insulator portion of the wire without straining the conductor portion of the wire.

Figure 8:
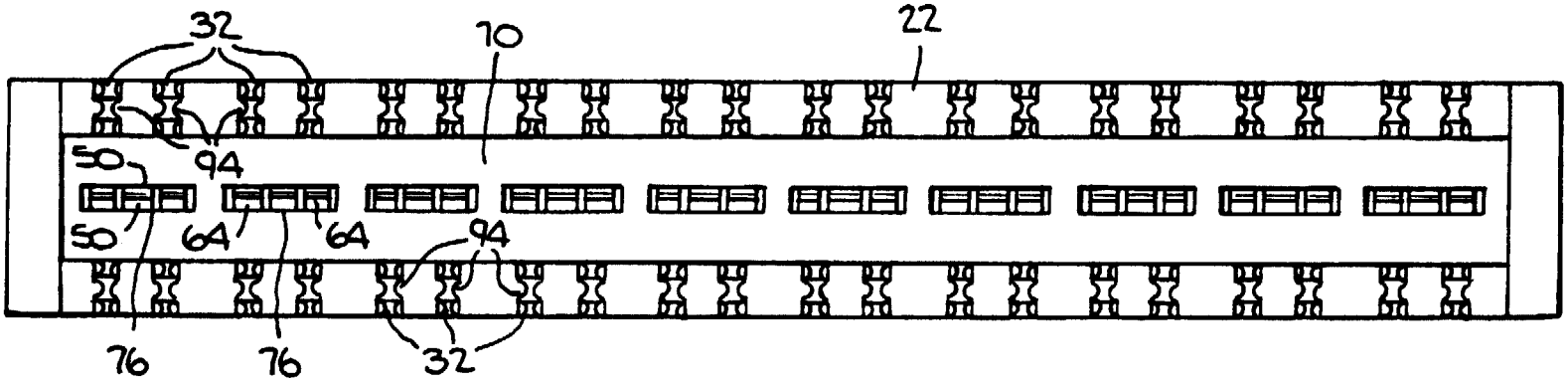
FIG. 8 is a view taken along line 8—8 of FIG. 3.

As can be seen in FIG. 8, each of the insert slots 76 in the side wall 70 is aligned with two sets of mating contacts 64 of associated spring connector elements 52 and one set of ground elements 52 from the ground strip 48. Also, as shown, the wire insertion slots 32 in the contact holder 22 and their associated wire connection slots 94 are aligned with the mating contacts 64. Thus, it will be seen that when a wire is laid into one of the slot assemblies 32, 94 at the top of the device and another wire is laid into the aligned slot assembly 32, 94 at the bottom of the device, the wires will be electrically connected to each other via the mating contacts 64 which are seen and are accessible through the associated insert slot 76. The connection between these wires will be broken when the contacts 64 are separated as by inserting an insulative member into the slot 76.

Figure 9:
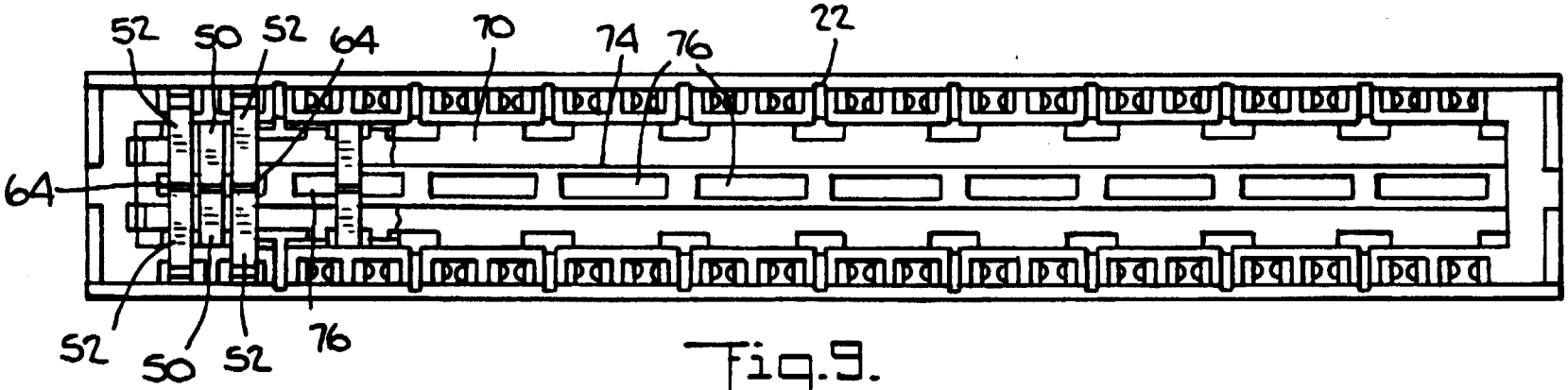
FIG. 9 is a view taken along line 9—9 of FIG. 3.

The actual spring connector elements 52 with their contact elements can be seen at the left end of FIG. 9. FIG. 9 also shows the ground elements 50 connected to the ground strip 48, as well as ground connector fingers 96 at the end of the ground strip. The connector fingers are connected to ground via an external connection (not shown).

Figure 10:
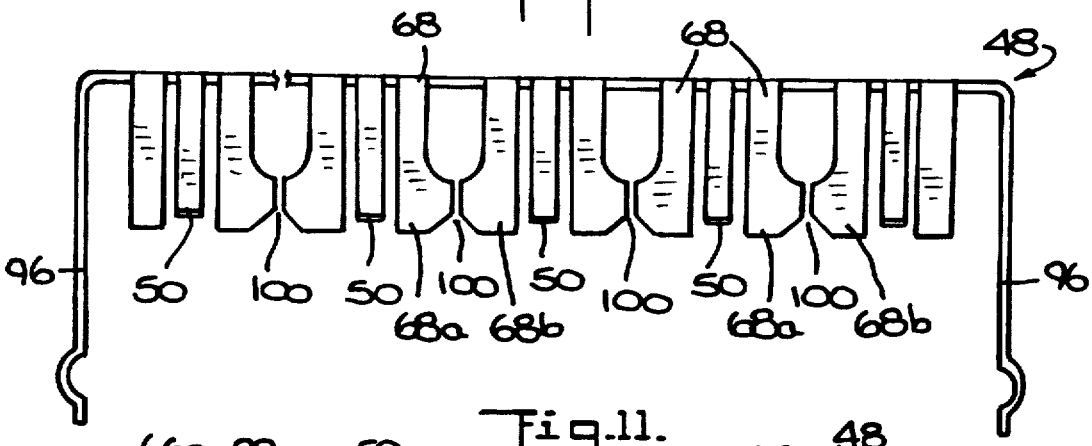
FIG. 10 is a top view, partially broken away, of a ground element used in the connector block assembly of FIGS. 1-3.
Figure 11:
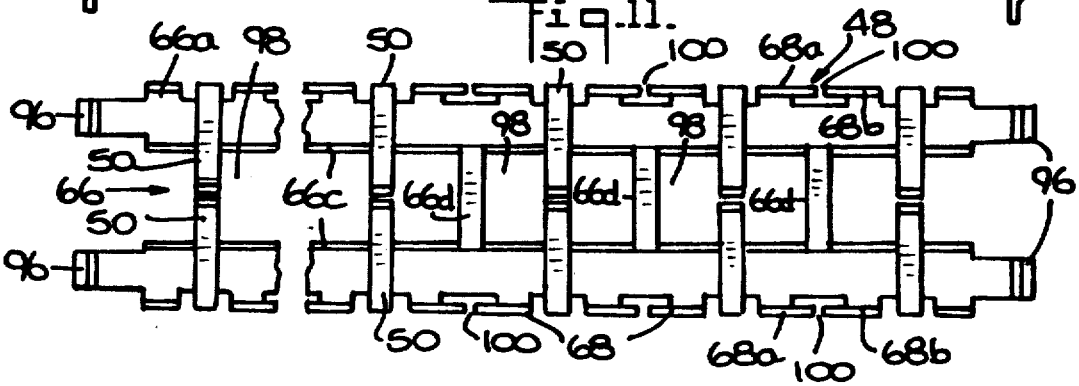
FIG. 11 is a side elevational view of the ground element of FIG. 10.

FIGS. 10 and 11 show the construction of the ground strip 48. Preferably this element is stamped out of sheet metal which is resilient and which has high electrical conductivity, for example, tempered pre-plated brass. The base portion 66 of the ground strip comprises two spaced apart parallel elongated base elements **66*a* and 66*b* which are bent along their facing edges to form flanges 66*c* and which are connected to each other by bridging portions 66*d* extending between the upper edges of the flanges 66*c* at spaced apart locations. Between the bridging portions 66, which extend across the ridge 76 at the same locations as the walls 40 in the base 20, are openings 98 which are in alignment with the slots 76 in the side wall 70 of the contact holder 22. The ground elements 50 are bent up from the outer edges of the base elements 66*a* and 66*b* at locations midway between the bridging portions 66*c*, i.e. in the center of the openings 98. Between the adjacent ground elements 50 are the shield contact elements 68. These elements are bent up to extend at a right angle to the base elements 66*a* and 66*b*. The shield contact elements 68 are each split centrally with slots 100 which divide each element into two segments 68*a* and 68*b*. The slots 100, which are located in alignment with the bridging portions 66*c*, accommodate the edges of the shield plates 44 and make electrical contact with those plates in assembly. The ground connection fingers 96 are bent from the ends of the base elements 66c and 66b** in generally the same direction as the shield contact elements.

Figure 12:
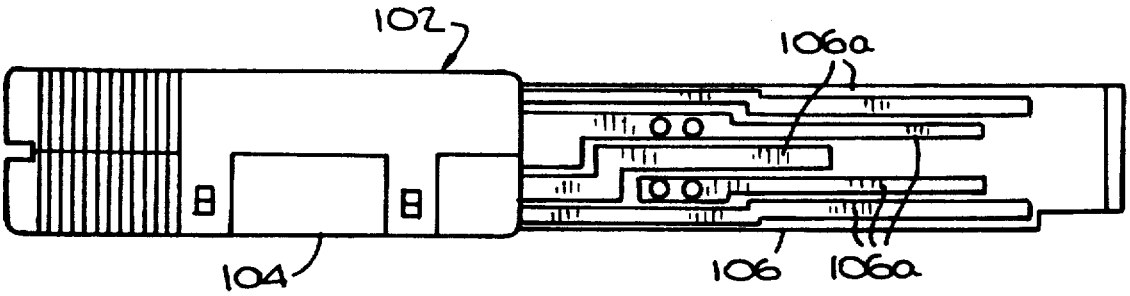
FIG. 12 is an elevational view of one side of a protector module used with the connector assembly of FIGS. 1-3.
Figure 13:
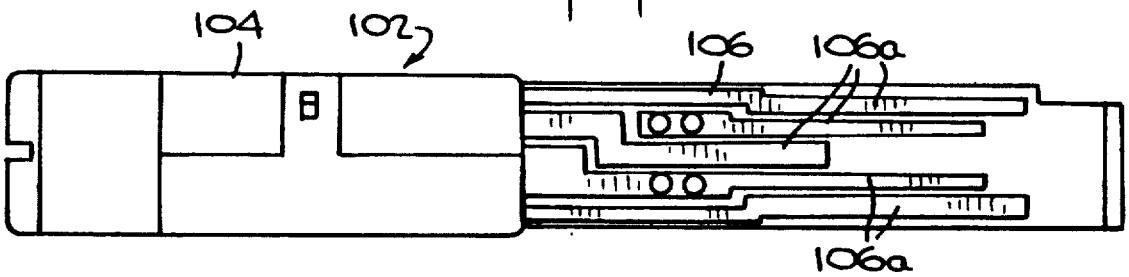
FIG. 13 is an elevational view of the other side of the protector module of FIG. 12.

FIGS. 12 and 13 show opposite sides of an insert module 102 that can be used in the above described connector assembly. The insert module 102 comprises a module casing 104 which contains electrical circuits and related elements suitable to the purpose of the module, for example circuit testing, circuit protection or circuit access. A blade-like insert element 106 extends out from the module casing 104. The insert element is shaped to fit into the insert slots 76 and to enter into the assembly so as to contact and separate the pairs of mating contacts 64 and ground elements 50 which are aligned with the particular slot 74 in which the element 106 is inserted. The insert element 106 is electrically non-conductive but it has electrically conductive plating 106a along its opposite sides to contact the various contacts 64 and ground elements 50 when they become separated by the insertion of the insert element 106. The plating 106a is electrically connected to the various electrical circuits and elements contained in the module casing.

The particular arrangement of the plating 106a and of the electrical circuits and elements within the casing 104 is not part of this invention nor does it relate to the best mode for carrying out the invention. The specific arrangement of circuits and other elements will be dictated by the application or use to which the connector assembly and the insert module 102 are put. Also such insert modules per se are well known. Accordingly, in the interest of clarity, the details of a particular insert module are not given herein.

As can be seen from the above description, the spring finger ground elements 50 are arranged in line with the spring finger ends of the spring finger connector elements 52 so that an insert element which is inserted into one of the slots 76 will first engage and spread apart the ground elements 50 and thereafter, as it is inserted further, will engage and spread apart the contacts 64 of the connector elements 52. The spring finger connector elements 52 are connected to signal carrying wires which are inserted into the slot assemblies 32, 94 and therefore the spring finger connector elements 52 and their associated contacts 64 may be referred to as signal contacts. It will also be noted that one contact of each mating pair of these signal contacts 52 is arranged along one line on one side of a center line in the assembly and the other contact of each mating pair is arranged along a second line on the other side of the center line. Also, the probe insert openings 74 are arranged along the center line. In addition, the signal contacts 52 extend within the assembly from their wire connecting ends 52 on one side of the openings 74, around the ground strip 48 to locations on the other side of the openings. The wire connecting recess assemblies 32, 94 are close to but are separated from the ground strip 48.

FIGS. 14–17 show different stages of insertion of an insert module into one of the insert slots 74 of the connector assembly.

Figure 14:
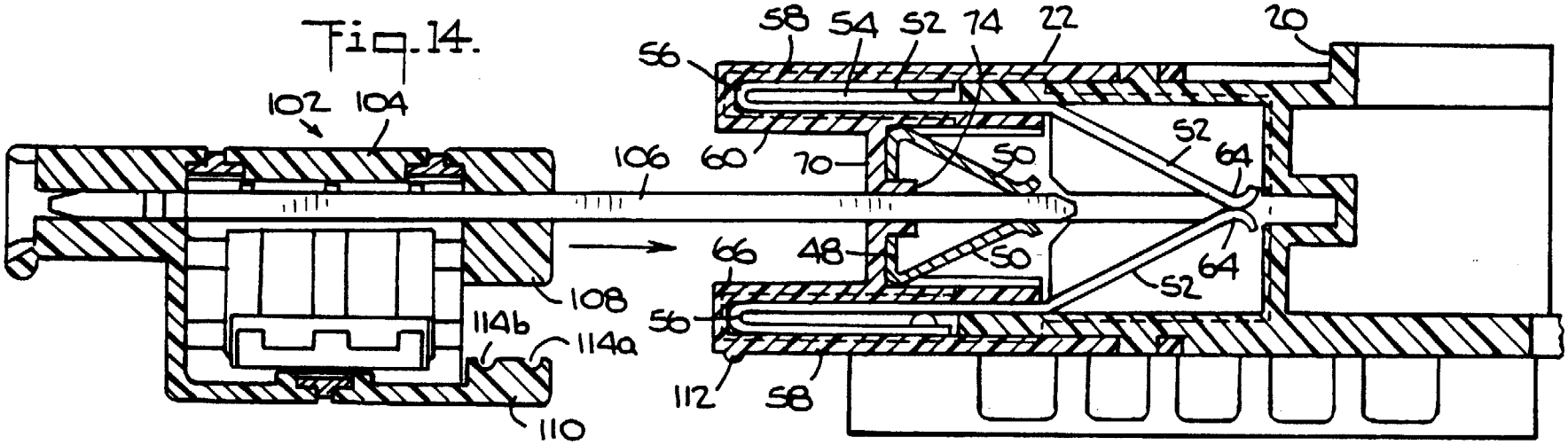
FIG. 14 is a view taken along line 14—14 of FIG. 1 and showing a protector module partially inserted into the connector assembly.

As shown in FIG. 14, the tip of the insert element 106 enters through the slot 74 and first contacts the ground elements 50 and separates them. This is a particularly advantageous feature of the invention because it ensures that the ground contacts will be engaged before any contacts that may be carrying a voltage. Thus, the likelihood of blowing out circuits in the insert module 102 is minimized.

Figure 15:
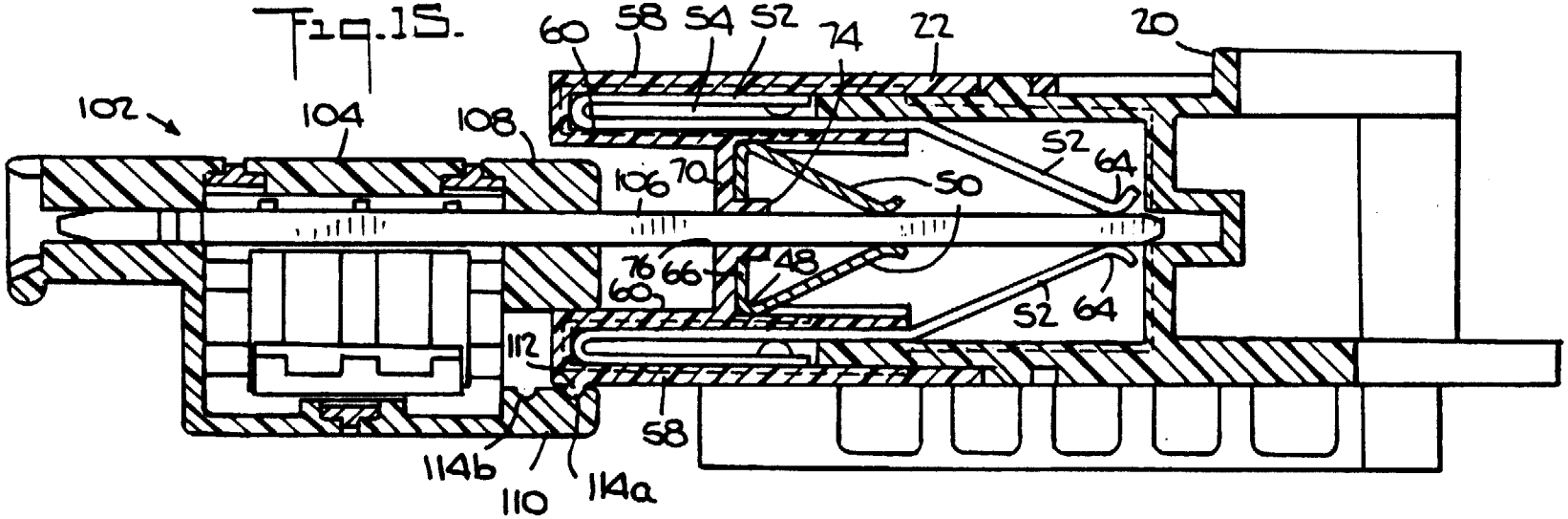
FIG. 15 is a view similar to FIG. 14, but showing the protector module at a first operating position in the connector assembly.

As shown in FIGS. 14 and 15, the casing 104 of the insert module 102 is formed with a plug portion 108 which fits snugly between the inner walls 60 of the contact holder 22. In addition, the casing 104 of the insert module 102 is formed with an arm 110 which extends parallel to and spaced from the plug portion 108. The spacing between the plug portion 108 and the arm 110 is such that they can straddle one of the outer side walls 58 and an associated inner wall 60 of the contact holder 22.

Figure 16:
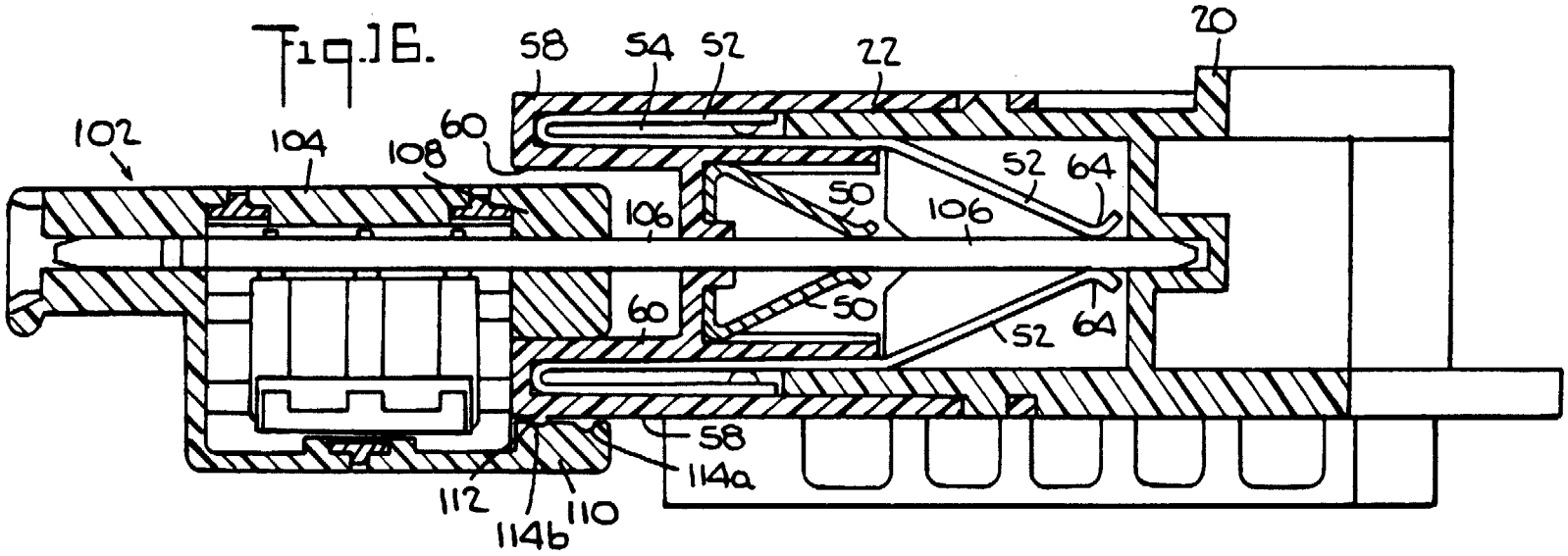
FIG. 16 is a view similar to FIG. 15, but showing the protector module at a second operating position in the connector assembly.

A projection 112 is formed on an outer surface near the end of the outer side wall 58 which is engaged by the insert module arm 110. The arm 110 itself is formed with a pair of detents 114a and 114b, each of which can accommodate the projection 112. When the insert module 102 is inserted to a first operating position as shown in FIG. 15, it is held in that position by the cooperation of the projection 112 and the first detent 114a. In this operating position the insert element 116 has engaged and separated the contacts 64 of the spring connector elements. However, the insert module 102 may be pushed in even farther to a second operating position, as shown in FIG. 16 where the projection 112 engages the second detent 114b. The projection and detent thus hold the module steady in this second operating position.

The two operating positions of the insert module bring different plated regions 106a of the insert element 106 into and out of engagement with the contacts 64 and the ground elements 50. Thus, different circuit connections are made possible by providing detent and projection arrangements which hold the insert module 102 in different operating positions. Also, the detent and projection arrangement in cooperation with the plug and arm configuration provides a stable and reliable operating structure.

Figure 17:
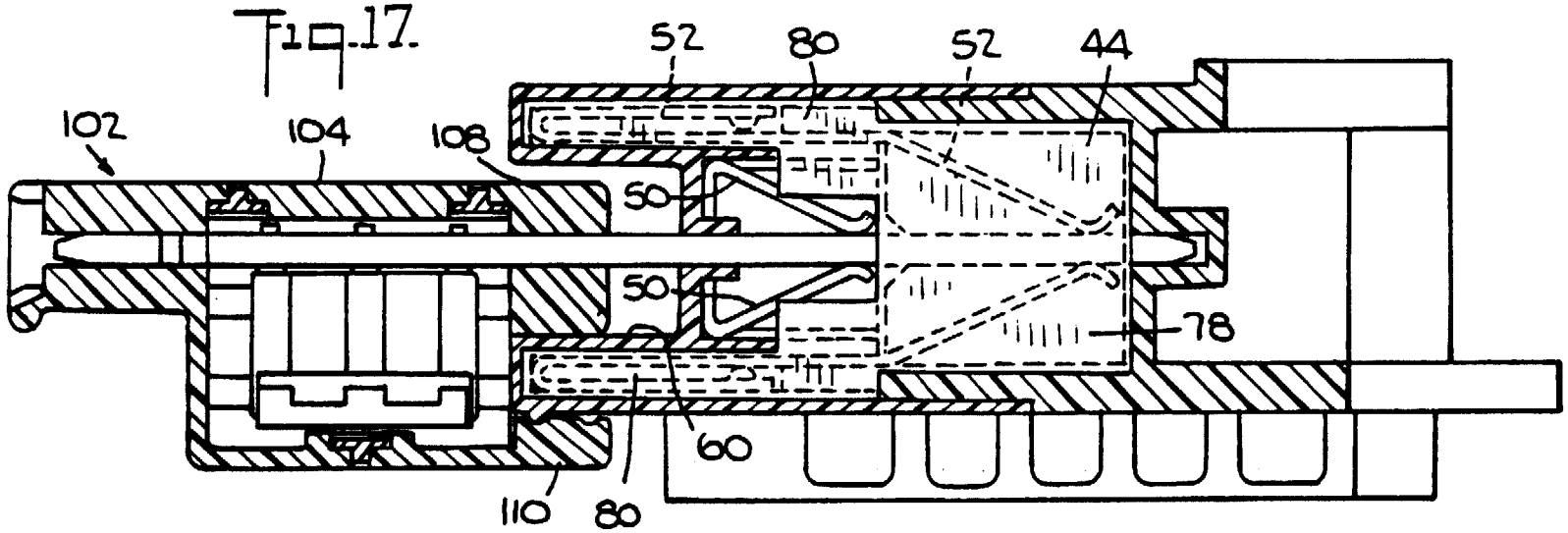
FIG. 17 is a view similar to FIG. 16, but taken at a different cross-sectional location along the length of the connector assembly of FIG. 1.

Turning now to FIG. 17, which is the same as FIG. 16 but taken at a different cross-section along the assembly, it will be seen that the electrically conductive shield plates 44 extend over the area occupied by the mutually facing surfaces of different groups of spring connector elements 52. As explained above, the shield plates 44 are connected to ground by virtue of their engagement in the slots 100 in the shield contact elements 68 of the ground strip 48. These shield plates are capable of preventing cross-radiation between adjacent groups of connector elements and thus permit very close spacing between these groups. Accordingly, a high density of signal carrying wires and connectors is made possible without undesirable cross-talk.

As seen from the above, the electrically conductive shield plates 44 have a surface area at least as great as the projected area between adjacent pairs of the connector elements 52.

I claim:

1. A connector assembly for providing a plurality of closely spaced connections to mutually adjacent conductors which, respectively, conduct different high frequency electrical signals, said connector assembly comprising:

an elongated insulative block, a plurality of connector elements mounted in closely spaced arrangement within said block, said block being formed with openings providing access for said mutually adjacent conductors to be connected to the ends of corresponding mutually adjacent ones of said connector elements, whereby said mutually adjacent ones of said connector elements conductor said different high frequency signals, said mutually adjacent connector elements having projected areas extending toward each other, electrically conductive shields mounted within said block between said mutually adjacent connector elements to prevent crosstalk between said connector elements, said shields each having a surface area extending over the entire projected area between said mutually adjacent connector elements, and a conductive strip extending along the length of said block and contacting said shields.

2. A connector assembly according to claim 1, wherein said conductive strip is connected to ground.

3. A connector assembly according to claim 1, wherein said mutually adjacent connector elements each comprise a set of two connectors, the connectors of each pair each having, at the end opposite their respective wire connecting end, a spring finger end, the spring finger ends of each set being biased into contact with each other.

4. A connector assembly according to claim 3, wherein said spring fingers are moveable into and out of contact with each other and thereby define an expanded projected area, and wherein said shields have a surface area which extends over said entire expanded projected area.

5. A connector assembly according to claim 4, wherein spring finger ground contacts are arranged to be contacted by an insert member which moves said spring fingers out of contact with each other, said spring finger ground contacts being electrically connected to said conductive strip.

6. A connector assembly according to claim 4, wherein an electrically conductive strip is mounted in said block to extend in closely spaced relationship to each of said connector elements, said strip being formed with contact portions which are contacted by said shields.

7. A connector assembly according to claim 6, wherein said contact portions are shaped to form slots into which said shields extend.

8. A connector assembly for providing a plurality of closely spaced connections to wires which conduct high frequency electrical signals, said connector assembly comprising:

an elongated insulative block, a plurality of connector elements mounted in closely spaced arrangement within said block, said block being formed with openings providing access for individual wires to be connected to the ends of corresponding ones of said connector elements, electrically conductive shields mounted within said block between adjacent connector elements to prevent crosstalk between said connector elements.

said connector elements comprising pairs of connectors, the connectors of each pair each having a wire connecting end and a spring finger end, the spring finger ends being biased into contact with each other, the spring finger ends being moveable into and out of contact with each other, said shields each having a surface area at least as great as a projected area between adjacent pairs of connectors over the range of movement of their spring fingers, and spring finger ground contacts arranged to be contacted by an insert member which moves said spring fingers our of contact with each other, said spring finger ground contacts being electrically connected to said shields, said spring finger ground contacts being formed on a common electrically conductive strip which extends along said block in closely spaced relationship to each of said connector elements and said electrically conductive shields being in contact with said strip.

9. A connector assembly according to claim 8, wherein said electrically conductive strip is formed with slots into which said shields extend.

10. A connector block assembly comprising:

an insulative block;

a pair of electrically conductive signal contacts mounted in said block, said signal contacts each having a spring finger biased to contact the spring finger of the other contact;

said block being formed with an opening providing access to a probe which can be inserted into said block to engage and separate said spring fingers;

and a ground contact mounted within said block between said opening and said spring fingers to be contacted by said probe upon insertion thereof into said block and before said probe engages said spring fingers.

11. A connector block assembly according to claim 10, wherein said block contains a plurality of pairs of said electrically conductive signal contacts, one contact of each pair being arranged along one side of a line and the other contact of each pair being arranged along the other side of said line, said block being formed with corresponding openings spaced apart along said line for insertion of probes into said block to engage the spring contacts of each pair and wherein a plurality of said ground contacts are mounted within said block between said openings and their respective spring fingers.

12. A connector block assembly according to claim 11, wherein said ground contacts extend from a common electrically conductive ground strip which extends within said block along of said line.

13. A connector block assembly according to claim 12, wherein said signal contacts each have a wire connecting end which extends within said block from locations along one side of said openings, around said ground strip to locations on the other side of said openings.

14. A connector block assembly according to claim 13, wherein said block is formed with recesses close to but separated from said ground strip for accommodating said wire connecting ends.

15. A connector block assembly according to claim 14, wherein said block is formed with wire access channels which open out from said recesses to permit connection of wires to said wire connecting ends.

16. A connector block assembly according to claim 11, wherein said block is formed with slots located between adjacent openings to accommodate electrically conductive shields.

17. A connector block assembly according to claim 16, wherein said shields are electrically connected to said ground strip.

18. A connector block assembly according to claim 17, wherein said ground contacts extend from a ground strip which extends along said line.

19. A connector block assembly according to claim 12, wherein said ground strip is contained within a channel formed within said block, said channel extending along a path parallel to and between said openings and one of the signal contacts of each pair.

* * * * *

UNITED STATES PATENT AND TRADEMARK OFFICE

CERTIFICATE OF CORRECTION

PATENT NO. : 5,160,273

DATED : November 3, 1992

INVENTOR(S) : WILLIAM V. CARNEY

It is certified that error appears in the above-identified patent and that said Letters Patent is hereby corrected as shown below:

On title page,

AT [56] REFERENCES CITED

Other Publications, under Research Disclosure, "'Duel-Level" should read --'Dual-Level--.

AT [57] ABSTRACT

Line 2, "wired" should read --wires--.
Line 7, "detents" should read --detent--.

COLUMN 1

Line 31, "their" should read --there--.

COLUMN 6

Line 23, "ground elements 52" should read --ground elements 50--.
Line 54, "ridge 76" should read --ridge 74--.

COLUMN 7

Line 5, "above described" should read --above-described--.

COLUMN 9

Line 1, "conductor" should read --conduct--.
Line 60, "other," should read --other, and--.
Line 68, "our" should read --out--.

UNITED STATES PATENT AND TRADEMARK OFFICE

CERTIFICATE OF CORRECTION

PATENT NO. : 5,160,273

DATED : November 3, 1992

INVENTOR(S) : WILLIAM V. CARNEY

It is certified that error appears in the above-identified patent and that said Letters Patent is hereby corrected as shown below:

COLUMN 10

Line 39, "of" should be deleted.

Signed and Sealed this

First Day of March, 199

Attest:

Attesting Officer

BRUCE LEHMAN

Commissioner of Patents and Trademarks